US007791438B2

(12) United States Patent
Lau et al.

(10) Patent No.: US 7,791,438 B2
(45) Date of Patent: Sep. 7, 2010

(54) MILLIMETER AND SUB-MILLIMETER WAVE WAVEGUIDE INTERFACE HAVING A JUNCTION OF TIGHT TOLERANCE AND A JUNCTION OF LESSER TOLERANCE

(75) Inventors: Yuenie S. Lau, San Jose, CA (US); Anthony Denning, San Martin, CA (US)

(73) Assignee: OML, Inc., Morgan Hill, CA (US)

( * ) Notice: Subject to any disclaimer, the term of this patent is extended or adjusted under 35 U.S.C. 154(b) by 122 days.

(21) Appl. No.: 12/151,096

(22) Filed: May 1, 2008

(65) Prior Publication Data

US 2008/0303613 A1 Dec. 11, 2008

Related U.S. Application Data

(60) Provisional application No. 60/933,596, filed on Jun. 7, 2007.

(51) Int. Cl.
*H01P 1/04* (2006.01)

(52) U.S. Cl. ..... 333/254

(58) Field of Classification Search ..... 333/254, 333/255, 260

See application file for complete search history.

(56) References Cited

U.S. PATENT DOCUMENTS 6,448,875 B1 * 9/2002 Sciarrino ..... 333/254
2007/0252665 A1 * 11/2007 Voss et al. ..... 333/254

* cited by examiner

*Primary Examiner*—Benny Lee
(74) *Attorney, Agent, or Firm*—Matthew J. Temmerman; Temmerman Law Office

(57) ABSTRACT

A waveguide interface for millimeter wave and sub-millimeter wave applications adapted to couple and uncouple abutting waveguide sections wherein said waveguide interface acts as both a mating surface and a precision alignment mechanism. The waveguide interface comprises a first member having a first waveguide defined therein, a second member having a second waveguide similar in cross-section to said first waveguide defined therein, a means for mating said first member and said second member comprising a centrally located precision mating surface through which propagates electromagnetic energy and additionally comprising at least one pair of diametrically opposed rotational alignment pins and holes located a specified distance from said centrally located precision-mating surface, and wherein said pins and holes are in mating relation of looser fitment than said centrally located precision mating surface.

12 Claims, 19 Drawing Sheets

MILLIMETER AND SUB-MILLIMETER WAVE WAVEGUIDE INTERFACE HAVING A JUNCTION OF TIGHT TOLERANCE AND A JUNCTION OF LESSER TOLERANCE

RELATED APPLICATION

This application is based on provisional application 60/933,596, filed Jun. 7, 2007.

FIELD OF THE INVENTION

The present invention relates to electromagnetic waveguides, particularly to an improved waveguide interface wherein the waveguide interface acts as both a mating surface and a precision alignment mechanism for millimeter wave and sub-millimeter wave applications.

GENERAL BACKGROUND

Waveguides are used to guide electromagnetic, light, or sound waves. The type of waveguide is dependent on the type of wave to be propagated. The most common waveguide design is a simple hollow metal conductor tube inside which the wave travels, eventually exiting and propagating outward and away from the exit point of the tube. For certain types of waveguide's wherein the wave is kept in a confined medium (air filled waveguide, dielectric filled waveguide, slot-line waveguide, slot-based waveguide etc.) waveguide interface is the only physical means to connect different waveguide components together to allow the waves to propagate therethrough.

Typical waveguides are made from materials such as brass, copper, silver, aluminum, or any other metal that has low bulk resistivity. Waveguide structures have conventionally been assembled in several ways. Dip-brazing is a process for joining aluminum waveguides, wherein a thin doping layer is applied at the point of connection, thereby lowering the melting point at that one contact point so the waveguides may be joined. Electroforming allows the entire waveguide structure to be built up layer by layer through electroplating. Other methods include electronic discharge machining and computerized numerically controlled machining.

Waveguides are becoming more commonly used in the millimeter wave and sub-millimeter wave industry, which includes frequencies above 30 GHz. This high band of electromagnetic waves is currently beginning to be used on many new devices and services, such as high-resolution radar systems, point-to-point communications and point-to-multipoint communications.

Because in general, higher frequency waves require a smaller waveguide, it is very important in the millimeter wave and sub-millimeter wave range that waveguides be machined very precisely. At the smallest sizes even the highest machining tolerances begin to present problems. For instance, to propagate frequencies above 110 GHz, the precision with which the waveguide flanges must be machined is greater than can easily be achieved. Hence, at frequencies of 110 GHz and above, it is common for the waveguide interface to become the weak link in a system.

Under the current standardizations objectives by the U.S. Department of Defense (hereinafter "MIL Spec") for specified tolerances and the standard alignment pins to alignment holes method, the smaller the waveguide, the greater the relative misalignment and the greater the impact to the system electrical performance. The problem becomes so great that at 680 GHz, the flange and the waveguide can be misaligned as much as a quarter of a wavelength—that is, half the physical waveguide dimension. The problem is detectable at frequencies as low as 200 GHz, and begins impacting electrical performance severely as frequency approaches 400 GHz.

The effect of waveguide misalignment is degraded electrical performance of the waveguide, such as increased voltage standing wave ratio (VSWR). The more accurately the waveguide interfaces are aligned, the better behaved and more predictable is the waveguide system performance.

There is thus a need for an improved waveguide interface design that offers improved performance repeatability, VSWR frequency response and a more robust mechanical handling without the use of conventional alignment pins to alignment holes techniques.

DESCRIPTION OF THE PRIOR ART AND OBJECTIVES OF THE INVENTION

Alignment tolerances on standard flanges such as MIL Spec MIL-F-3922/67B (hereinafter "the standard 67B flange") and MIL Spec MIL-F-3922/74 (hereinafter "the 74 flange") are acceptable for most applications, however, when smaller wavelengths are used and in particular above 110 GHz, these standards are no longer adequate.

The standard 67B flange and the 74 flange standards were developed years ago and were not intended to account for the required alignment precision for waveguide bands approaching the sub-millimeter wave region. The more precise 74 flange is reasonably accurate for use in WR-08 (90 GHz to 140 GHz) and WR-06 (110 GHz to 170 GHz) applications but lacks precision when applied to applications smaller than WR-06.

Although the 74 flange has a more precise interface than the standard 67B, the 67B waveguide flange has nonetheless become the accepted standard waveguide interface to 750 GHz and higher by both manufacturers and end-users. This is due to the ease of interface among different components such as mixers, multiplier, circulators, isolators, attenuators, filters, etc.

Four manufacturers of waveguide kits have attempted to improve the 67B flange locator pin tolerance precision by adding two additional alignment pins having even tighter tolerances. This modification to the standard 67B flange will be referred to as the precision 67B flange. Since proper waveguide section alignment depends on the accurate positioning of the flange alignment pins and the flange alignment holes to the waveguide center, the two additional alignment pins advanced the art enough to allow the 67B flange to remain a standard in the art.

To better understand the advancement made by the precision 67B flange over the standard 67B flange, the Applicant analyzed the two, assuming a perfect waveguide and assuming the alignment holes are referenced to the true center of the waveguide aperture. It is first noted that the mechanical tolerances allowed for the alignment pins and the alignment holes dictate the amount of misalignment that in turn directly influences the waveguide interface electrical performance. These mechanical tolerances establish the absolute misalignment magnitude, which ultimately is, independent of waveguide bands.

The deviations from true alignment were calculated by the Applicant for four misaligned positions representing each of the major axial deviations that could be readily modeled, the four positions being broad wall, narrow wall, diagonal and rotated. The magnitude shown in each case is the algebraic worst case sum of each of the tolerances, i.e., the tolerance of the placement of the hole circle for the alignment pins and holes about the true center of the waveguide aperture, the tolerance allowed error in rotational position for the alignment pins and alignment holes and the allowed tolerance on the diameter of the alignment pins and alignment holes. Broad wall and narrow wall misalignment (offset) were shown to have the largest possible misalignment magnitude and are the leading cause in electrical performance degradation.

The standard 67B flange's maximum broad wall and narrow wall offset was found to be 0.0043". This offset is the algebraic sum of the maximum tolerance buildup between the two alignment pinholes and the mating alignment holes. FIG. 5 exemplifies the effect broad wall misalignment has on the waveguide's return loss. A 25% broad wall misalignment can degrade electrical performance of the waveguide to less than 10 dB return loss at the low end of the waveguide operating range and to less than 20 dB return loss at the high end of the waveguide operating range.

The precision 67B flange has a maximum broad wall and narrow wall offset of 0.0025". The tighter tolerance callout between the two alignment holes, located above and below the waveguide aperture, makes it possible to decrease the misalignment magnitude by more than 40% over the standard 67B flange. The precision 67B flange waveguide interface, with its tighter control over the machine positioning tolerances, has not diminished the need for a more accurate flange interface. As frequencies used in the art continue to increase, as well as the need for increased performance, even the precision 67B flange is becoming unsuitable. Furthermore, the current "precision" alignment pin tolerances are at the state-of-the-art machining capability and improvement in further tightening these tolerances is neither likely nor practical.

The state of the art in waveguide manufacturing is thus presently limited by the tolerances attainable in drawing waveguide and cost-effective geometric techniques for identifying the "true center" of the waveguide aperture in order to locate the waveguide flange hole pattern and associated locater pins.

Thus, the present application discloses an innovative waveguide interface design that offers improved performance repeatability, VSWR frequency response and a more robust mechanical handling without being dependent on the tightly held machine tolerances of conventional alignment pins and the mating alignment holes.

It is thus an object of the present invention to improve the alignment of waveguide flanges used in the extremely high frequency portion of the electromagnetic spectrum.

It is a further object of the present invention to provide an extremely high frequency waveguide with improved performance repeatability, improved VSWR frequency response and a more robust mechanical handling.

It is a still further object of the present invention to provide an extremely high frequency waveguide with improved performance without the use of conventional alignment pins to eliminate holes technique.

It is a still further object of the invention to provide a waveguide flange interface whose accuracy cannot deteriorate due to initial alignment pin assembly, an accidental forceful engagement of alignment pins to the alignment holes or an accidental blunt trauma to the alignment pins.

SUMMARY OF THE INVENTION

An innovative waveguide interface design that offers improved performance repeatability, VSWR frequency response and a more robust mechanical handling without the use of conventional alignment pins to alignment holes technique is disclosed. The waveguide interface may be manufactured using techniques of reduced complexity as compared to current techniques. Finally, the device increases the ease and precision of waveguide alignment as compared to conventional waveguides. As one example, the performance of a WR-05 waveguide (in the range of 140 GHz to 220 GHz) is described. As system designs approach the sub-millimeter wave region, this interface design will mitigate much of the poor system performance attributed to waveguide interfaces.

In summary, the device comprises a waveguide interface for millimeter wave and sub-millimeter wave applications adapted to couple and uncouple abutting waveguide sections wherein said waveguide interface acts as both a mating surface and a precision alignment mechanism. The waveguide interface comprises a first member having a first waveguide defined therein, a second member having a second waveguide similar in cross-section to said first waveguide defined therein, a means for mating said first member and said second member comprising a centrally located precision mating surface through which propagates electromagnetic energy and additionally comprising at least one pair of diametrically opposed rotational alignment pins and holes located a specified distance from said centrally located precision mating surface, and wherein said pins and holes are in mating relation of looser fitment than said centrally located precision mating surface.

BRIEF DESCRIPTION OF THE FIGURES

The foregoing aspects and many of the attendant advantages of the invention will become more readily appreciated as the same becomes better understood by reference to the following detailed description, when taken in conjunction with the accompanying drawings, wherein like features in different embodiments will be designated by the same reference number and their full description may be omitted, and wherein.

DETAILED DESCRIPTION OF THE INVENTION

A waveguide flange is a ring forming a rim at the end of a waveguide used for interfacing the waveguide with different components such as mixers, multiplier, circulators, isolators, attenuators, filters, etc. See generally, FIG. 1. For purposes of this patent application, waveguide shall refer to any type of waveguide where waveguide interface is the only physical means to connect different components together to allow waves to propagate through. In general, this refers to waveguides used in the transmission of electromagnetic waves in the 110 GHz range and above.

To facilitate alignment of a waveguide, conventional flanges comprise flange alignment holes that are a prescribed distance from the true center of the waveguide aperture within the flange. Flange alignment pins are similarly positioned and threaded through the flange alignment holes, securing the two parts together. Waveguide alignment is thus contingent on the positioning of the flange alignment pins and the flange alignment holes within the flange. In contrast, the Applicant's approach relies on the concentricity of waveguide mating interfaces, that is, the fact that they share a common axis.

Figure 1:
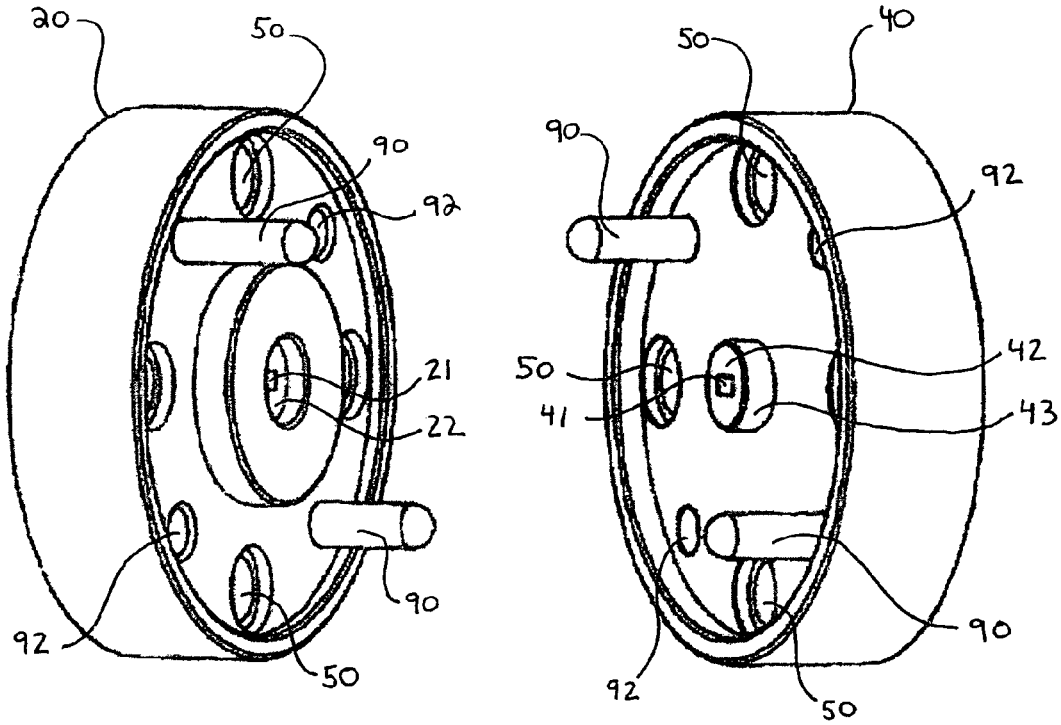
FIG. 1 is a perspective view of the applicant's flange according to a preferred embodiment of the invention.
Figure 2:
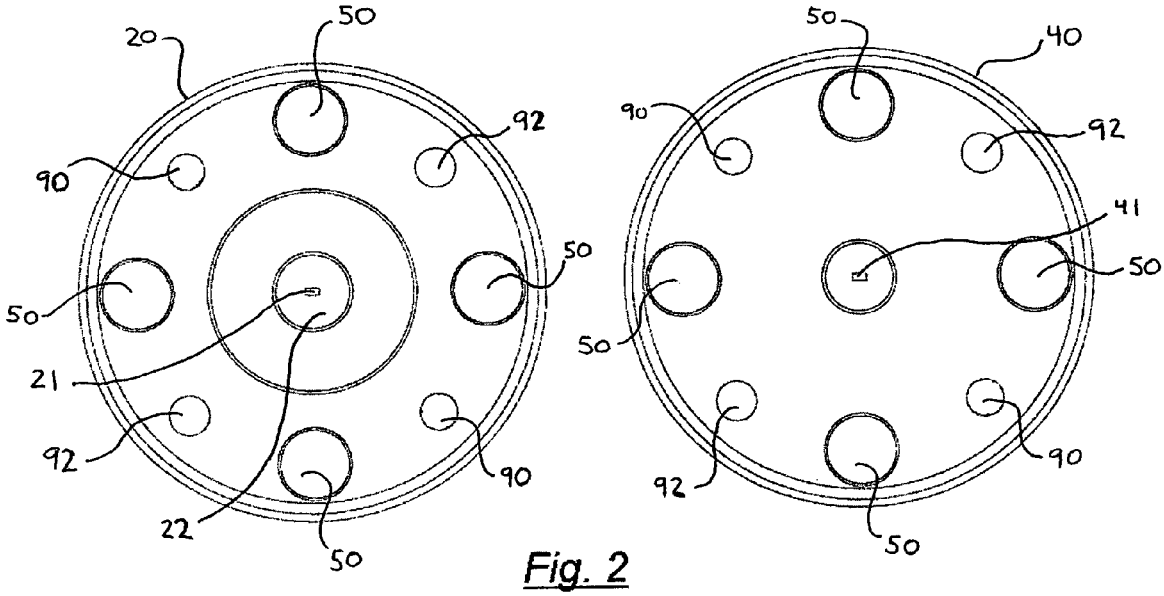
FIG. 2 is a planar view of the applicant's flange according to a preferred embodiment of the present invention.
Figure 3:
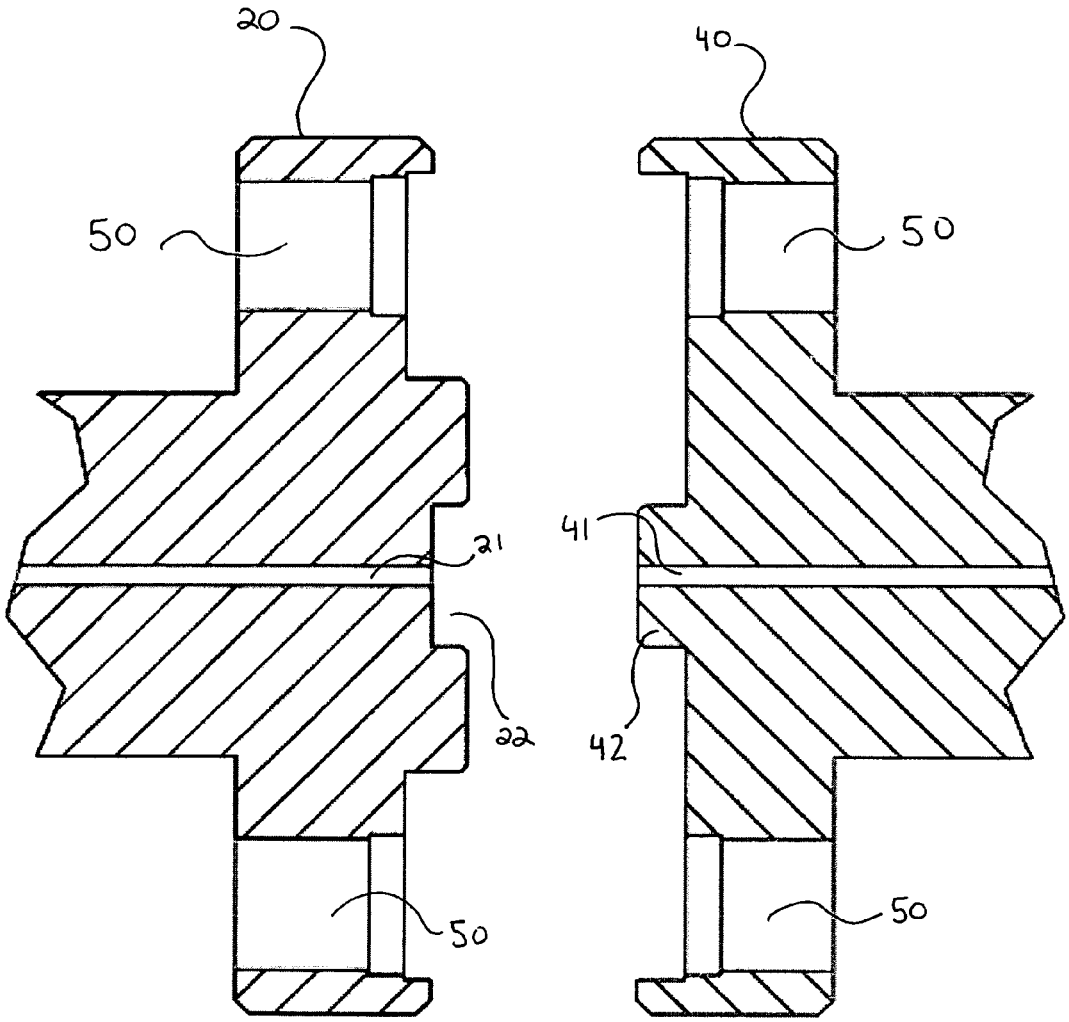
FIG. 3 is a side profile view of the applicant's flange according to a preferred embodiment of the present invention.

Continuing with FIGS. 1 and 2, the two waveguide components are distinguished for ease in understanding as a socket 20 and a plug 40, capable of mating together as shown in FIGS. 17A-17B, 18A-18B, and 19A-19B. Returning now to FIG. 1, in the center of the waveguide flange is the waveguide aperture, through which propagates the wave. For the socket 20 and plug 40, the aperture shall be referred to as socket aperture 21 and plug aperture 41, respectively.

Figure 17A:
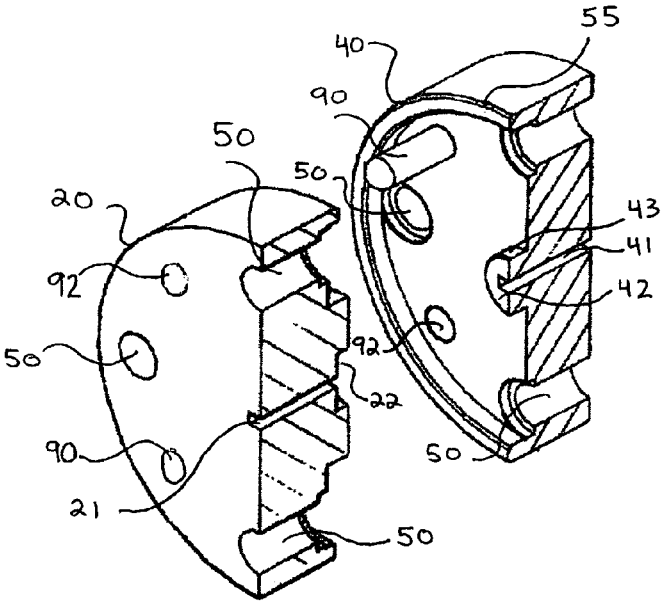
FIG. 17A is a cutaway perspective view of the applicant's flange according to a preferred embodiment of the invention.
Figure 17B:
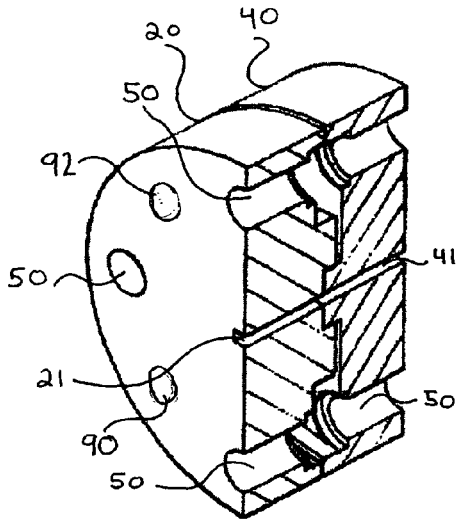
FIG. 17B is the same view as and components as FIG. 17A wherein the components are mated.
Figure 18A:
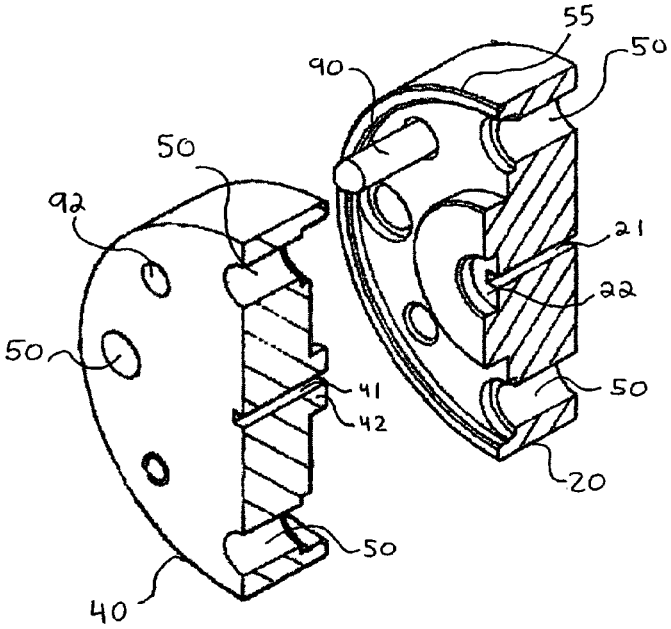
FIG. 18A is a reverse perspective view of the applicant's flange according to a preferred embodiment of the invention.
Figure 18B:
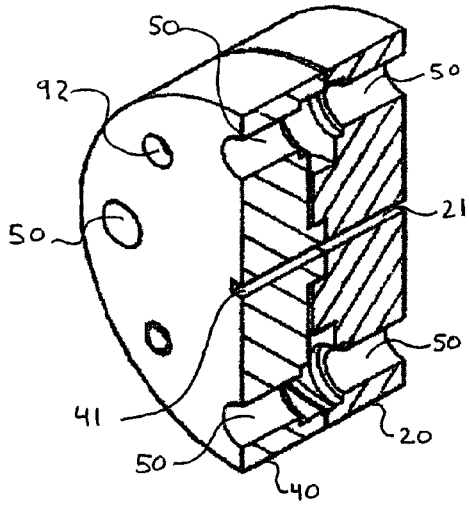
FIG. 18B is the same view as and components as FIG. 18A wherein the components are mated.
Figure 19A:
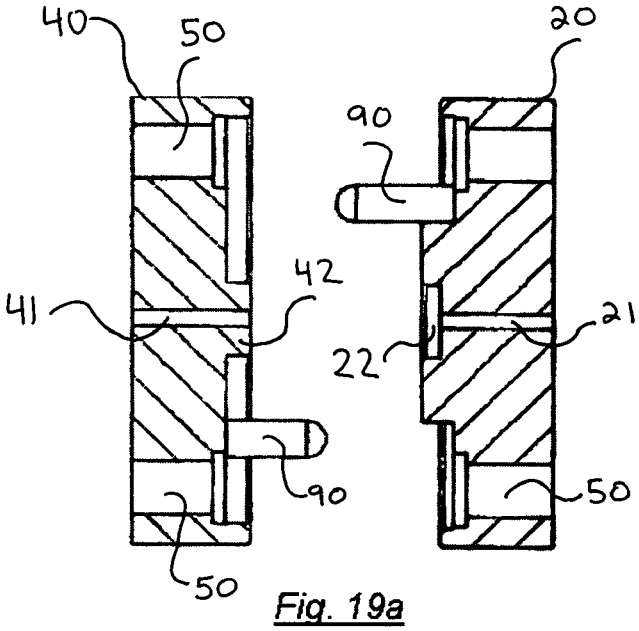
FIG. 19A is a cross-sectional view of the applicant's flange according to a preferred embodiment of the invention.
Figure 19B:
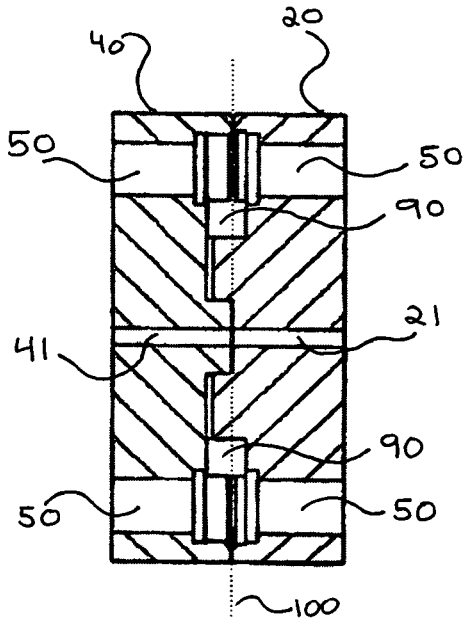
FIG. 19B is the same view as and components as FIG. 19A wherein the components are mated.

Referring again to FIG. 1, the waveguide interface minimizes the number of interdependent tolerances by having only one tightly held tolerance recess 22 centering on the waveguide aperture. The counterpart to recess 22 on socket 20 is a precision boss 42 on plug 40, machined in the same process used to create the recess. Boss 42 comprises a boss outer edge 43 and just as recess 22 does on the socket 20, and acts as the one tightly held tolerance component for plug 40. Recess 22 comprises socket aperture 21 at its exact center and boss 42 comprises plug aperture 41 at its exact center. Since recess 22 and boss 42 compliment each other, when mated as shown in FIGS. 17B, 18B, and 19B, the two apertures are brought together with a high level of precision. In alternative embodiments of the invention not shown, the waveguide end having the socket can be swapped with the waveguide end having the plug and vice versa.

When connected, the plug and socket system creates a high degree of precision in the x and y-axis (that is, along the connecting plane), but very little to no precision regarding rotation. To ensure rotational precision is maintained, standard pins 90 and pinholes 92 as are known in the art are used. Since all rotational alignment is dependent on pins 90 interfacing with pinholes 92 precisely, any amount of pin misalignment can lead to rotational misalignment. However, since the pin interface is far from the center of the waveguide, a slight misalignment due to pin matching tolerances in this region causes a smaller and smaller misalignment as position moves radially inward from the pin. That is, because a misalignment of a set amount at the center of the structure will have much more of a rotational effect than the same misalignment at the edge of the structure, the overall rotational prevision is high even if the pins and pinholes' precision is not. Understanding this, the standard pins 90 can be machined to the standard 67B tolerance and yet not negatively impact the system.

To secure the connection, screws (not shown) may be screwed into each of mounting screw holes 50, shown in FIGS. 1 and 17A, 17B, 18A, 18B, 19A and 19B. Additionally, an anti-cocking ring 55 assures proper flatness of mating between 22 and 42 as in conventional flanges. See FIG. 18A.

Because the waveguide interface acts not only as the mating surface but also as the precision alignment mechanism, the Applicant's waveguide flange does away with the need to utilize multiple precision alignment pins and holes. The precision recess 22 on one side of the waveguide aperture surface and a precision boss 42 on the other side of the waveguide interface aperture surface replace the function of the convention alignment pin and alignment hole relating to the X-Y axis. The role of the alignment pin and alignment hole has instead been relegated to merely relating to rotational alignment.

As briefly stated above, recess 22 and boss 42 are machined to fit together, and thus any misalignment error therein is equal to the level of machine tolerance in their production.

Wear and tear around the recess 22 surface and the boss outer surface edge 43 cannot degrade the alignment precision set forth by the original machine finish because the precision alignment resides in the concentricity of the recess 22 adjacent to the mating face and the concentricity of the boss 42 diameter away from the boss outer surface edge 43.

The Applicant's method of using the mating surface as the precision alignment mechanism will provide benefits to any waveguide used at over 110 GHz. Examples include but are not limited to air filled waveguide, dielectric filled waveguide, slot-line waveguide, slot-based waveguide etc. As a specific example, the Applicant details two such designs.

One is constructed from a standard 67B flange and the other is a two-piece split-block design.

Because this design does not use alignment pins for maintaining alignment in the X-Y plane, one advantage is that interface accuracy is highly resistant to problems from slight intolerances in initial alignment pin assembly, an accidental forceful engagement of alignment pins to the alignment holes or accidental blunt trauma to the alignment pins. Moreover, the plane of interface 100 created by the junction of recess 22 and boss 42 is either recessed below the outer flange ring (not shown) and or flush with the outer flange ring as shown in FIG. 19B, making the design substantially resistant to drop damage compared to the alignment pin design.

The Applicant performed additional misalignment testing using this method and discovered that the maximum broad wall and narrow wall offset is reduced to 0.0012" when recess 22 and boss 42 are machined using the same tolerance limits as in the precision 67B flange. Thus, using the current commercially available machining such as that used in the manufacture of the precision 67B flange (having a maximum broad wall and narrow wall offset of 0.0025"), a waveguide flange having a maximum broad wall and narrow wall offset of 0.0012" is produced, resulting in a significant advancement in the precision of waveguide alignment.

Figure 4:
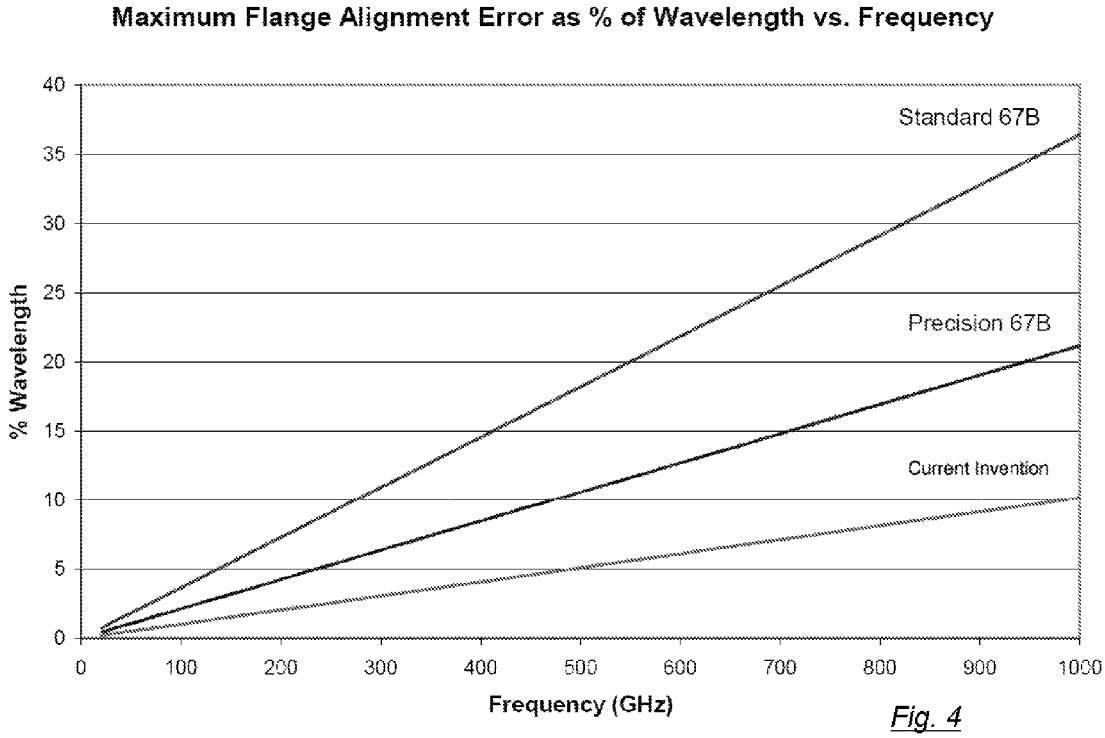
FIG. 4 is a graph showing the maximum flange alignment error as a percentage of wavelength on the Y-axis and the frequency in GHz on the X-axis.

Turning now to FIG. 4, the effect of broad wall offset as frequency increases is illustrated. Near 700 GHz, a standard 67B flange can have as much as a one-quarter-wavelength interference at the waveguide interface, which is half the physical waveguide dimension. Although the precision 67B has less broad wall interference, it still can have interference up to an eighth of a wavelength. In contrast, the Applicant's design showed a maximum of merely one-sixteenth of a wavelength interference at this frequency.

Figure 11:
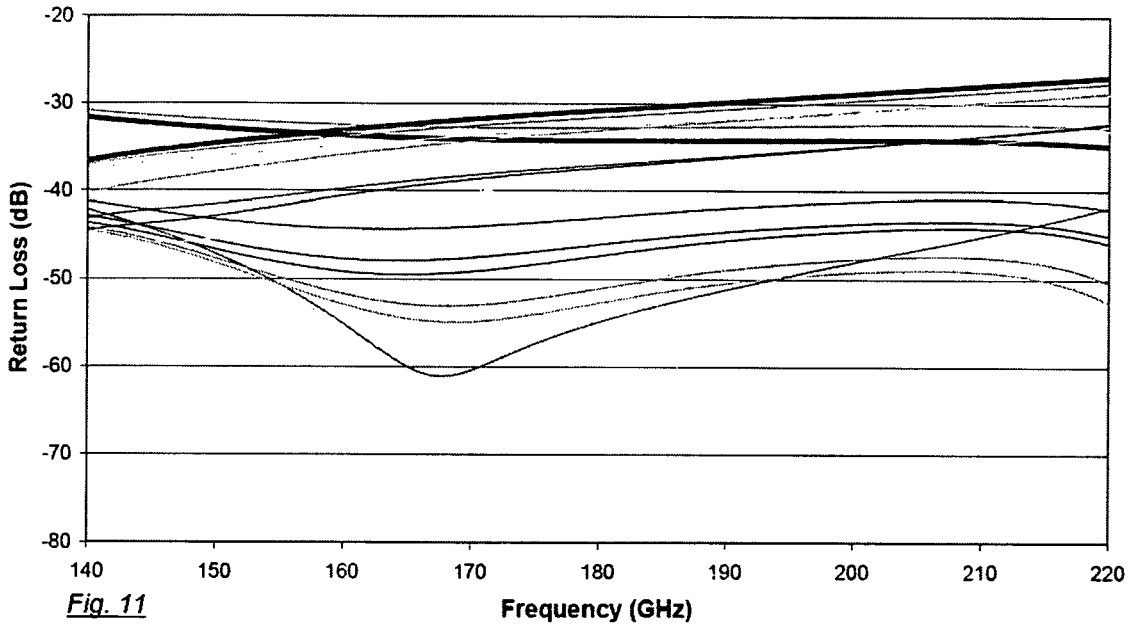
FIG. 11 is a second graph showing the WR05 Standard 67B repeatability. 15 random insertions taken from a second sample are shown. The return loss in decibels is shown on the Y-axis and frequency in GHz is shown on the X-axis.

Measurements were performed on four different types of WR-05 67B flanges. It is important to note that the applicant's design can be applied to any current means for interfacing two closed waveguides use in the 110 GHz range and above, but for simplicity purposes 67B flanges were chosen for testing. First, simulations of maximum misalignment positions were analyzed using an electromagnetic field simulator for a standard 67B flange, a precision 67B flange, a split block 67B flange, and an electroform 67B flange. The split block 67B flange supports a waveguide manufactured through splitting the waveguide half way down the broad wall and then mechanically assembling the two to form a complete waveguide section. FIG. 11 shows the performance of the actual parts of which the Applicant's electroform 67B design comprises, machined from a commercially available precision 67B.

Figure 5:
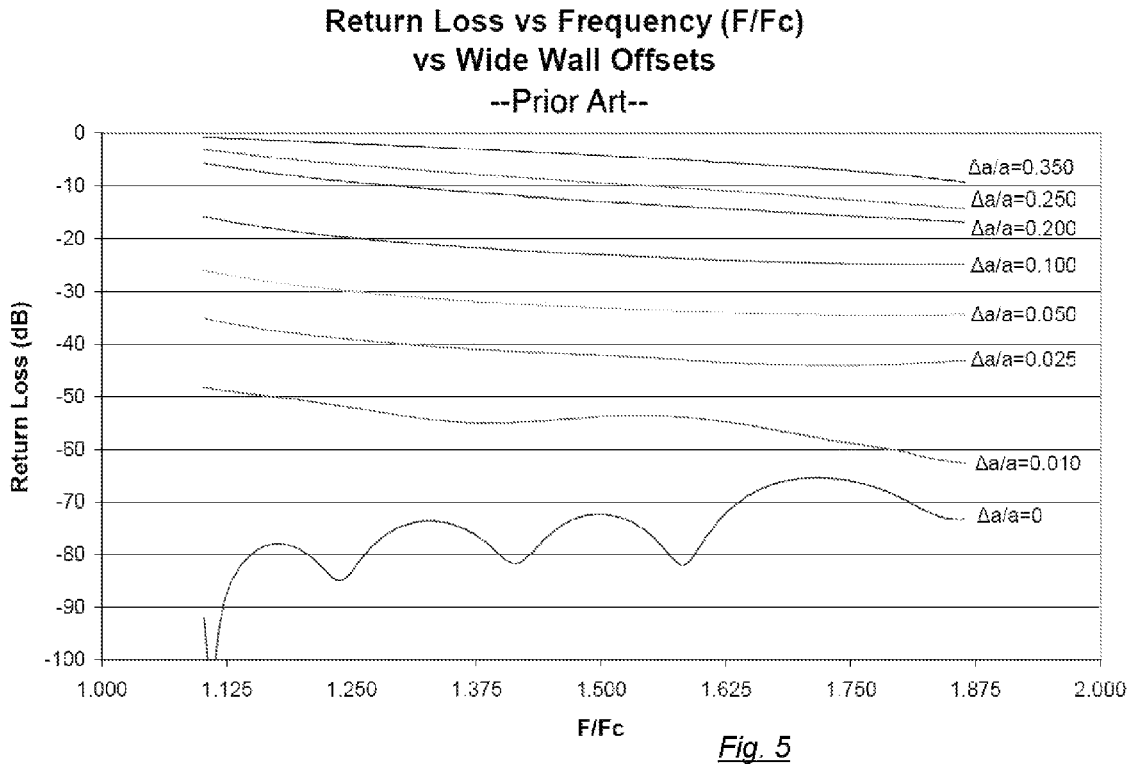
FIG. 5 is a graph showing the return loss in decibels on the Y-axis, the frequency F/Fc on the X-axis at varying amounts of broad wall offsets.
Figure 6:
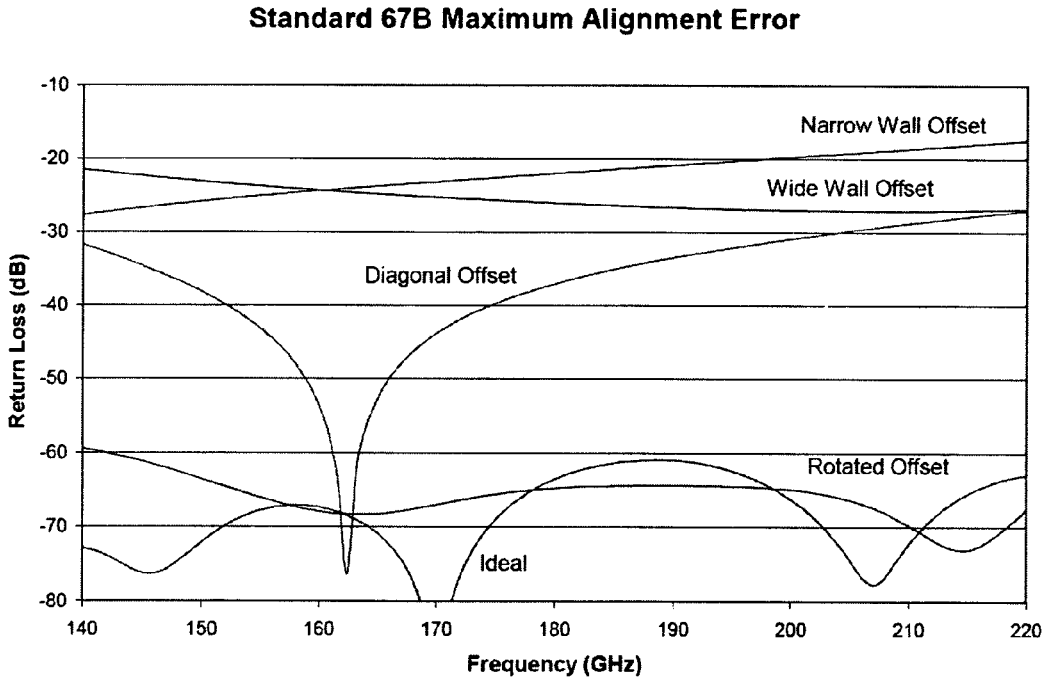
FIG. 6 is a graph showing the standard 67B maximum alignment error. The return loss is shown in decibels on the Y-axis and the frequency is shown in GHz on the X-axis.
Figure 7:
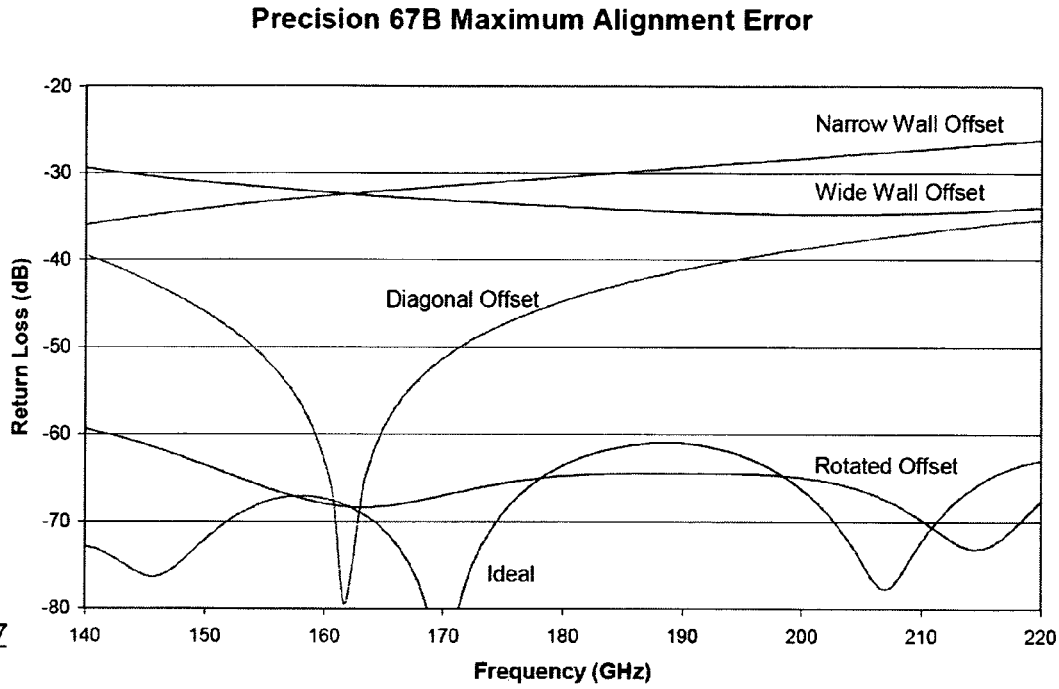
FIG. 7 is a graph showing the precision 67B maximum alignment error. The return loss is shown in decibels on the Y-axis and the frequency is shown in GHz on the X-axis.

The results of these simulations are shown in FIGS. 6, 7, 8, and 9. In each plot, the return loss in dB is shown along the Y-axis and frequency is shown along the X-axis. For each graph, a simulated "perfect" waveguide interface is shown in each of the plots, better illustrating the degradation from Perfect transmission due to misalignment. FIG. 6 shows the standard 67B maximum misalignment error. The magnitude shown in each case is the algebraic worst case sum of each of the tolerances, i.e., the tolerance of the placement of the hole circle for the alignment pins and holes about the true center of the waveguide aperture, the tolerance allowed error in rotational position for the alignment pins and alignment holes and the allowed tolerance on the diameter or the alignment pins and alignment holes. FIG. 7 illustrates the precision 67B maximum misalignment error, which is still significant. FIG. 5 exemplifies the effect broad wall misalignment has on the waveguide's return loss. A 25% broad wall misalignment can degrade electrical performance of the waveguide to less than 10 dB return loss at the low end of the waveguide operating range and to less than 20 dB return loss at the high end of the waveguide operating range.

Figure 8:
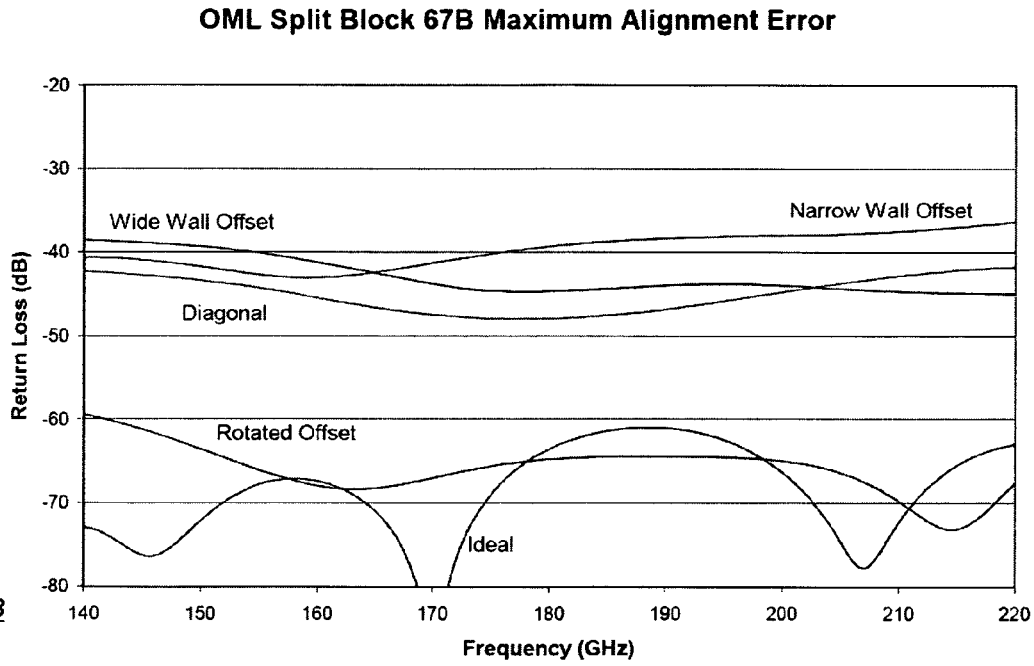
FIG. 8 is a graph showing the applicant's split block 67B maximum alignment error. The return loss is shown in decibels on the Y-axis and the frequency is shown in GHz on the X-axis.
Figure 9:
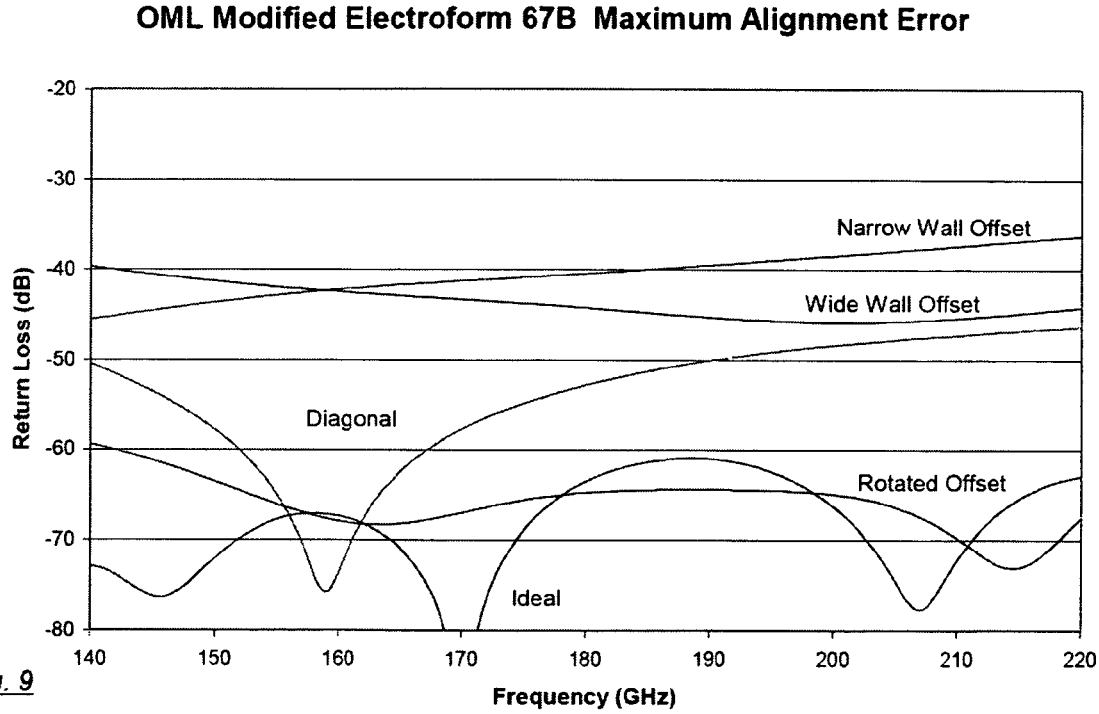
FIG. 9 is a graph showing the Applicant's modified electroform 67B maximum alignment error. The return loss is shown in decibels on the Y-axis and the frequency is shown in GHz on the X-axis.

FIGS. 8 and 9 represent simulations of flange designs employing the Applicant's new method of manufacture. FIG. 8 represents simulations regarding misalignment error with respect to the split-block design and FIG. 9 represents simulations regarding misalignment error with respect to the one-piece design taken from a modified 67B flange.

Table 1, below, summarizes the analysis criteria and observations of the analysis plots depicted in FIGS. 6-9.

TABLE 1

| Type | Max Alignment Error Position | Observations |
|---|---|---|
| Standard 67B | Wide wall Offset = 0.0043"<br>Narrow Wall Offset = 0.0043"<br>Diagonal Offset = 0.003"<br>Rotated = 0.88° | Possible up to 11 dB variation in repeatability with worst case return loss of 18 dB and an average return loss of 25 dB |
| Precision 67B | Wide wall Offset = 0.0025"<br>Narrow Wall Offset = 0.0025"<br>Diagonal Offset = 0.0018"<br>Rotated = 0.88° | Possible up to 10 dB variation in repeatability with worst case return loss of 26 dB and an average return loss of 30 dB |
| Split Block 67B | Wide wall Offset = 0.0012"<br>Narrow Wall Offset = 0.0012"<br>Diagonal Offset = 0.0009"<br>Rotated = 0.88°<br>Split Offset = 0.001" | Possible up to 8 dB variation in repeatability with worst case return loss of 36 dB and an average return loss of 40 dB Split offset seems to smooth the diagonal offset response |
| Machined Electroform 67B | Wide wall Offset = 0.0012"<br>Narrow Wall Offset = 0.0012"<br>Diagonal Offset = 0.0009"<br>Rotated = 0.88° | Possible up to 7 dB variation in repeatability with worst case return loss of 36 dB and an average return loss of 40 dB |

In addition to simulated effects from misalignment error, actual measurements of return loss were obtained as well. The measurements were accomplished using a one-port calibration with a vector network analyzer and a WR-05 frequency extension module. Time domain with gating around the waveguide interface of interest and frequency domain with gating applied were employed to discern different waveguide interfaces. The gate length used in all gating functions was 1 mm. Each waveguide sample was subjected to a "best effort" in obtaining the maximum wide wall offset and maximum narrow wall offset and thirteen random connect and disconnect to show repeatability of each flange type.

Figure 10:
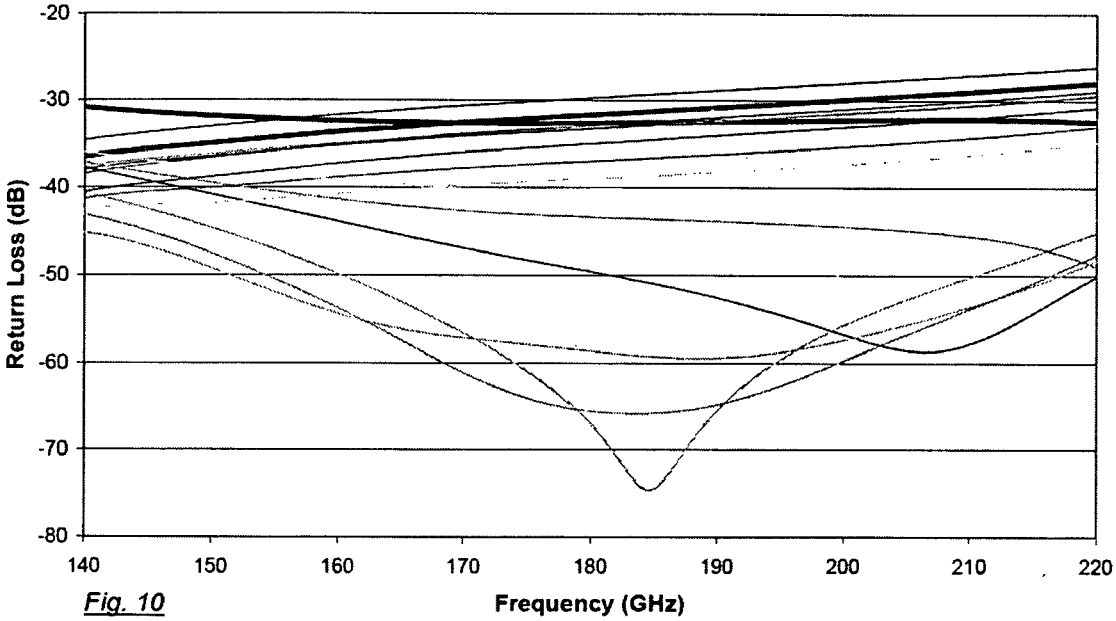
FIG. 10 is a first graph showing the WR05 Standard 67B repeatability. 15 random insertions taken from a first sample are shown. The return loss in decibels is shown on the Y-axis and frequency in GHz is shown on the X-axis.

FIGS. 10 and 11 depict plots showing a first and a second WR-05 standard 67B waveguide sample, respectively. FIG. 10 depicts the repeatability of the first sample taken from 15 random insertions while FIG. 11 depicts the repeatability of the second sample taken from 15 random insertions. In both FIGS. 10 and 11, the return loss in dB is shown on the Y-axis and frequency in GHz is shown on the X-axis. The return loss in sample 1 and sample 2 tracks the simulation misalignment error as shown in FIG. 6. Both measured samples have better return loss than simulation; this is due to manufacturers' ability to fabricate parts inside tolerance limits.

Figure 12:
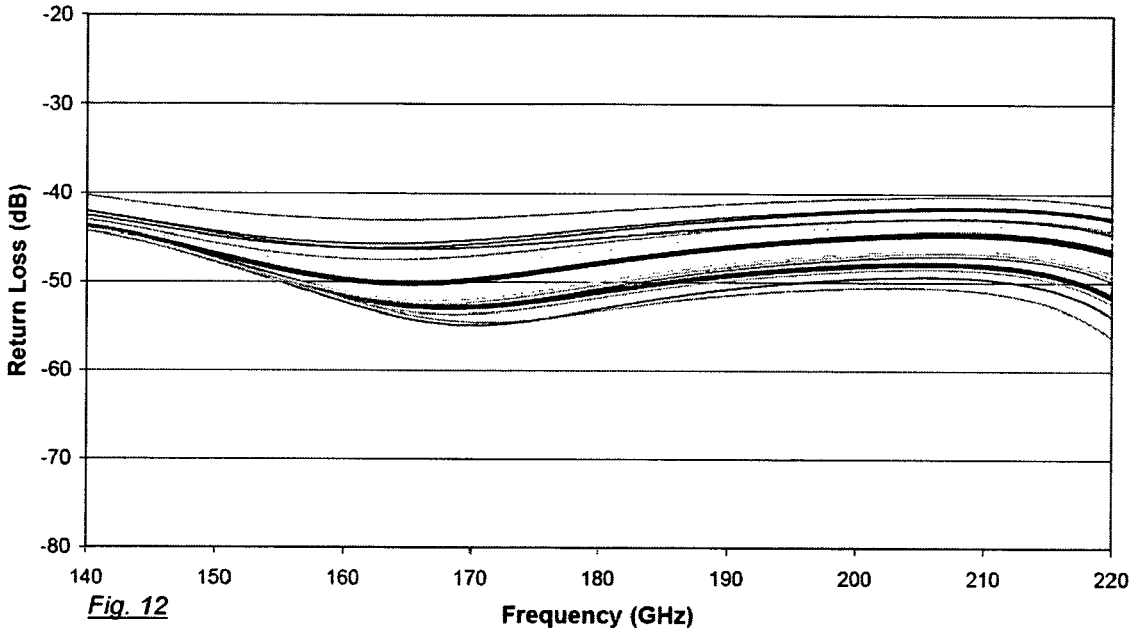
FIG. 12 is a first graph showing the WR05 Precision 67B repeatability. 15 random insertions taken from a first sample are shown. The return loss in decibels is shown on the Y-axis and frequency in GHz is shown on the X-axis.
Figure 13:
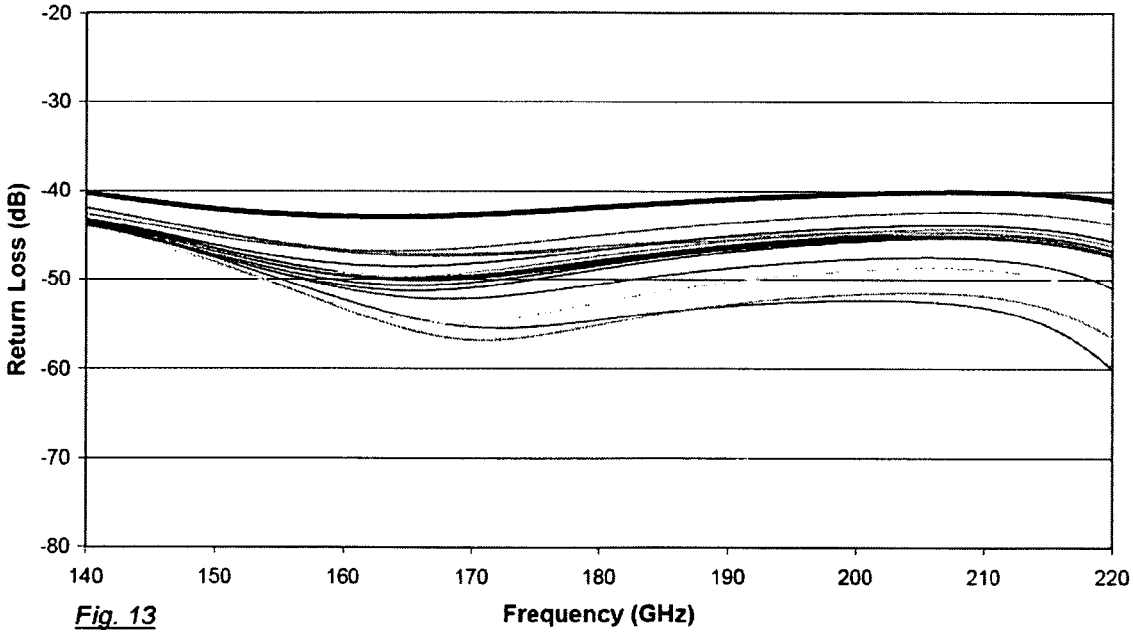
FIG. 13 is a second graph showing the WR05 Precision 67B repeatability. 15 random insertions taken from a second sample are shown. The return loss in decibels is shown on the Y-axis and frequency in GHz is shown on the X-axis.

FIGS. 12 and 13 depict essentially the same plot as shown in FIGS. 10 and 11, but for the precision 67B flange. FIG. 12 depicts the repeatability of the first sample taken from 15 random insertions while FIG. 13 depicts the repeatability of the second sample taken from 15 random insertions. In both Figures the return loss in dB is shown on the Y-axis and frequency in GHz is shown on the X-axis. These Figures again match up with FIG. 7, which shows the misalignment error. Again, the data are much better than simulation. Simulation assumes the worst-case error—that is, at maximum tolerance limits. In contrast, the measured data indicate the achieved machining tolerances. The data demonstrate the parts can easily be fabricated within the tolerance limit. The added center alignment pin technique improves the waveguide interface return loss and has a better-defined repeatability range than the standard flange that uses the outer diameter for its alignment.

Figure 14:
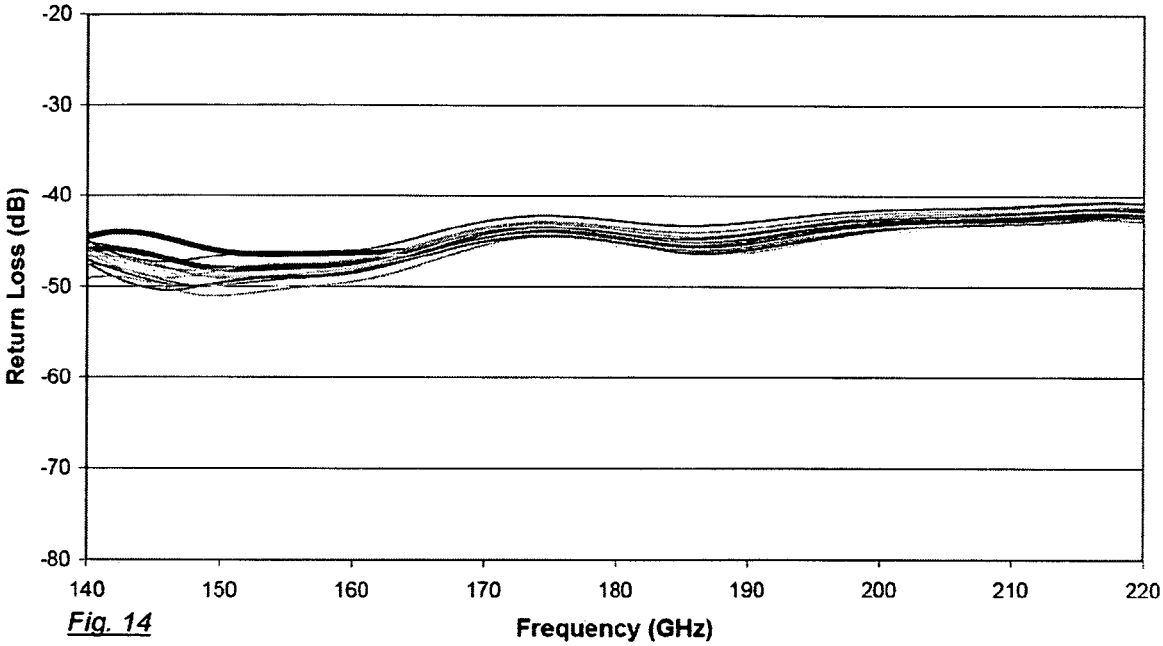
FIG. 14 is a first graph showing the WR05 split block 67B repeatability. 15 random insertions taken from a first sample are shown. The return loss in decibels is shown on the Y-axis and frequency in GHz is shown on the X-axis.
Figure 15:
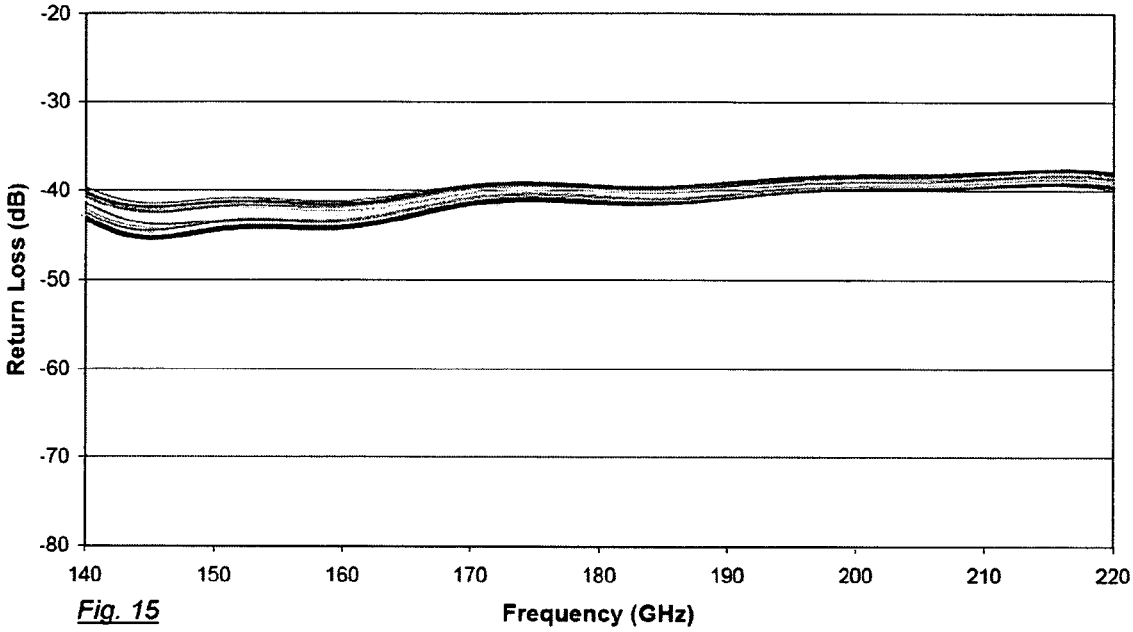
FIG. 15 is a second graph showing the WR05 split block 67B repeatability. 15 random insertions taken from a second sample are shown. The return loss in decibels is shown on the Y-axis and frequency in GHz is shown on the X-axis.
Figure 16:
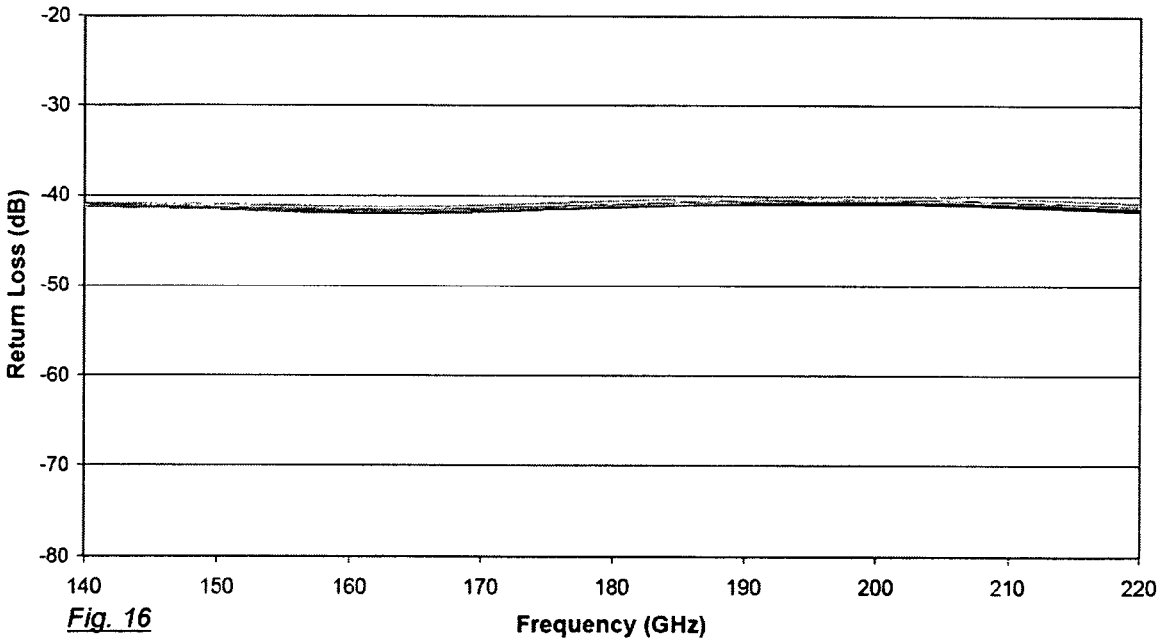
FIG. 16 is a graph showing the WR05 Electroform 67B repeatability. 15 random insertions are shown. The return loss in decibels is shown on the Y-axis and frequency in GHz is shown on the X-axis.

FIGS. 14 and 15 again depict essentially the same plots as shown in FIGS. 10 and 11 and FIGS. 12 and 13, but do so with the new alignment design for the split block 67B flange. Again, FIG. 14 depicts the repeatability of the first sample taken from 15 random insertions while FIG. 15 depicts the repeatability of the second sample taken from 15 random insertions. In both Figures the return loss in dB is shown on the Y-axis and frequency in GHz is shown on the X-axis. The data agree with the simulation shown in FIG. 8. Although the return loss in this design is similar to the precision 67B, the repeatability is far superior to the precision 67B. The two mating parts were simply joined and tightened with screw on either side of the waveguide aperture before data was taken. No alignment pins were used in the waveguide alignment process. The repeatability data reveals that this new alignment possesses a superior electrical performance without resorting to extreme and impractical machining tolerance specifications.

FIG. 18 shows data from the new alignment design modified from a 67B flange. The return loss data matches the simulation data shown in FIG. 9. Wherein FIG. 9 illustrates the theoretical maximum error from known machining tolerances, FIG. 18 shows the actual measured result on return loss.

The repeatability range is much more tightly knitted than simulation or any data obtained to date. The modified parts were simply secured together with screws; no alignment pins were used. The exceptional repeatability data shown here is a result of the Applicant's robust new design made using only currently commercially available end-mill machines.

With respect to the above description then, it is to be realized that the disclosed equations, figures and charts may be modified in certain ways while still producing the same result claimed by the Applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention.

We claim:

1. A waveguide interface for millimeter wave and submillimeter wave applications, the waveguide interface comprising:

a. a first member, the first member being provided with a precision recess having a centrally disposed aperture therethrough for connection to a first duct;

b. a second member, the second member being provided with a precision boss complimentary to said precision recess and having a centrally disposed aperture therethrough for connection to a second duct so as to join said first duct to said second duct;

c. at most one tightly held tolerance junction, wherein said tightly held tolerance junction is the junction of said boss and said recess mated together, and wherein said tightly held tolerance junction is centered on said centrally disposed aperture; and d. at least one additional mating junction between said first member and said second member, wherein said at least one additional mating junction is of lesser tolerance than said tightly held tolerance junction;

e. at least one pair of diametrically opposed rotational alignment pins located a specified distance from said centrally disposed aperture on said first member;

f. at least one pair of diametrically opposed rotational alignment holes located a specified distance from said centrally disposed aperture on said second member; and g. wherein said pins and holes form at least two additional mating junctions.

2. The waveguide interface of claim 1 wherein said precision recess and said precision boss are machined during a single process so as to fit together in a complementary manner.

3. The waveguide interface of claim 1 wherein said at least two additional mating junctions are of lesser tolerance than said tightly held tolerance junction.

4. The waveguide interface of claim 3 further comprising a mounting screw hole and screws threaded therethrough.

5. The waveguide interface of claim 3 further comprising an anti-cocking ring surrounding one of said first member or said second member.

6. A waveguide interface for millimeter wave and submillimeter wave applications adapted to couple and uncouple abutting waveguide sections wherein said waveguide interface acts as both a mating surface and a precision alignment mechanism, the waveguide interface comprising:

a. a first member having a first waveguide defined therein;

b. a second member having a second waveguide similar in cross-section to said first waveguide defined therein, said first member and said second member being constructed to define a cavity situated between one end of said first waveguide and one end of said second waveguide;

c. a means for creating a tightly held tolerance junction by mating said first member and said second member comprising a first mating surface and a complimentary second mating surface;

d. a precision alignment component for aligning said first and second member, the precision alignment component comprising a precision recess wherein said first waveguide is centrally located therein, and a precision boss wherein said second waveguide is centrally located therein;

e. wherein said precision recess and precision boss are said first and second mating surfaces, respectively;

f. at least one pair of diametrically opposed rotational alignment pins located a specified distance from said centrally disposed aperture on said first member;

g. at least one pair of diametrically opposed rotational alignment holes located a specified distance from said centrally disposed aperture on said second member; and h. wherein said pins and holes create a mating junction of lesser tolerance than said tightly held tolerance junction.

7. The waveguide interface of claim 6 wherein said precision recess and said precision boss are machined during a single process so as to fit together in a complementary manner.

8. The waveguide interface of claim 6 further comprising an anti-cocking ring surrounding one of said first member or said second member.

9. The waveguide interface of claim 6 further comprising a mounting screw hole and screws threaded therethrough.

10. A coupler for coupling two sections of waveguide, each section dimensioned to carry electromagnetic energy and terminating in a substantially flat end, said coupler comprising:

a. means for translationally aligning a first and second waveguide section ends as said ends are brought into contact, the means comprising a single junction of tightly held tolerance and centrally located within said coupler, and wherein said junction comprises the mating surfaces of a precision recess centrally located on said first waveguide section and a precision boss centrally located on said second waveguide section;

b. at least one pair of diametrically opposed rotational alignment pins located a specified distance from the center of a first waveguide section;

c. at least one pair of diametrically opposed rotational alignment holes located a specified distance from the center of a second waveguide section; and d. wherein said pins and holes create a mating junction of lesser tolerance than said junction of tightly held tolerance; and e. wherein said electromagnetic energy passes through said junction.

11. The waveguide interface of claim 10 further comprising a mounting screw hole and screws threaded therethrough and an anti-cocking ring surrounding one of said first member or said second member.

12. The coupler of claim 10 wherein said precision recess and said precision boss are machined during a single process.

* * * * *